US011165184B2

(12) United States Patent
Dogoldogol

(10) Patent No.: US 11,165,184 B2
(45) Date of Patent: Nov. 2, 2021

(54) ORIENTATION DEVICE

(71) Applicant: John Michael Dogoldogol, San Diego, CA (US)

(72) Inventor: John Michael Dogoldogol, San Diego, CA (US)

(73) Assignee: THE DOGOLDOGOL FAMILY TRUST, San Diego, CA (US)

( * ) Notice: Subject to any disclaimer, the term of this patent is extended or adjusted under 35 U.S.C. 154(b) by 0 days.

(21) Appl. No.: 16/792,059

(22) Filed: Feb. 14, 2020

(65) Prior Publication Data

US 2020/0266570 A1 Aug. 20, 2020

Related U.S. Application Data

(60) Provisional application No. 62/806,608, filed on Feb. 15, 2019.

(51) Int. Cl.
*H01R 13/46* (2006.01)
*H01R 13/52* (2006.01)

(52) U.S. Cl.
CPC ..... *H01R 13/465* (2013.01); *H01R 13/5213* (2013.01)

(58) Field of Classification Search
CPC ..... H01R 2103/00; H01R 13/641; H01R 13/6675; H01R 13/7175; H01R 24/28; H01R 31/06; H01R 13/44; H01R 13/465; H01R 13/562; H01R 13/565; H01R 13/633; H01R 13/6335; H01R 13/652; H01R 13/6641; H01R 13/665; H01R 13/70;

(Continued)

(56) References Cited

U.S. PATENT DOCUMENTS 4,884,981 A * 12/1989 Chandler ..... H01R 13/6593 439/607.41
6,520,796 B1 * 2/2003 Reichle ..... H01R 13/465 439/491

(Continued)

OTHER PUBLICATIONS

PCT/US2020/018687, "Invitation to Pay Additional Fees and, Where Applicable, Protest Fee", Apr. 28, 2020, 2 pages.

(Continued)

*Primary Examiner* — Edwin A. Leon
*Assistant Examiner* — Matthew T Dzierzynski
(74) *Attorney, Agent, or Firm* — Kilpatrick Townsend & Stockton LLP

(57) ABSTRACT

A cover for an AC plug comprises a top wall including one or more orientation features that protrude from a top surface of the top wall and first and second sidewalls that extend from the top wall in a perpendicular orientation relative to the top wall. First and second retainer walls extend from the first and second sidewalls, respectively, in a perpendicular orientation relative to the first and second sidewalls. The orientation features can be employed by a user to properly orient the AC plug when mating it with a corresponding receptacle connector. An orientation insert for an AC plug includes orientation features in addition to a light that can be activated by depressing a top surface of the insert. The light can be used to assist a user in locating a receptacle connector and positioning the AC plug to properly mate with the corresponding receptacle connector.

14 Claims, 6 Drawing Sheets

(58) Field of Classification Search
CPC ..... H01R 13/7172; H01R 13/72; H01R 2201/06; H01R 24/30; H01R 27/00; H01R 31/065
See application file for complete search history.

(56) References Cited

U.S. PATENT DOCUMENTS 6,799,898 B2 * 10/2004 Cheng ..... G02B 6/3879 385/55
7,004,595 B1 2/2006 Stoddard
7,303,416 B1 12/2007 Liao
7,361,047 B2 * 4/2008 Strahl ..... H01R 13/6272 439/354
7,431,604 B2 * 10/2008 Waters ..... H01R 13/582 439/344
7,540,756 B1 * 6/2009 Strahl ..... H01R 13/6272 439/344
7,578,692 B2 * 8/2009 Kaneda ..... H01R 13/633 439/159
7,686,638 B2 * 3/2010 Boyd ..... H01R 13/6272 439/344
7,708,581 B2 * 5/2010 Weiss ..... H01R 43/00 439/344
7,824,205 B2 * 11/2010 Scislak ..... H01R 13/633 439/344
9,287,661 B2 * 3/2016 Lee ..... H01R 13/6275
9,350,114 B2 * 5/2016 Liang ..... H01R 13/6275
2010/0304620 A1 12/2010 Huang
2012/0270435 A1 10/2012 Hale et al.
2014/0170903 A1 6/2014 Tuchrelo et al.
2016/0099521 A1 4/2016 Gzybowski

OTHER PUBLICATIONS

PCT/US2020/018687, "International Search Report and Written Opinion", dated Jul. 17, 2020, 5 pages.

* cited by examiner

ORIENTATION DEVICE

CROSS-REFERENCES TO OTHER APPLICATIONS

This application claims priority to U.S. provisional patent application Ser. No. 62/806,608, for "ORIENTATION DEVICE" filed on Feb. 15, 2019 which is hereby incorporated by reference in entirety for all purposes.

FIELD

The described embodiments relate generally to electronic connectors. More particularly, the present embodiments relate to AC plug connectors used for coupling an electronic device to the AC power grid.

BACKGROUND

Currently there are a wide variety of electronic plug connectors that enable an electronic device to be coupled to the AC power grid. Often, such plug connectors are polarized, allowing them to mate with a receptacle connector in only one orientation. However, it can be difficult to discern the proper orientation of the plug connector when attempting to mate it with a receptacle connector. In many circumstances it can also be difficult to see the receptacle connector, especially when it is positioned behind furniture or is in a recessed location. New plug connectors with features that enable a user to discern the proper orientation of the plug connector and location of a receptacle connector are needed.

SUMMARY

In some embodiments an orientation device for an AC plug comprises a cover configured to be attached to the AC plug and including one or more orientation features positioned on a top surface of the cover. In various embodiments the cover is formed in a shape of a clip defining a channel. In some embodiments the cover has a substantially "C" shaped cross-section including the top surface having a pair of arcuate arms extending therefrom. In some embodiments the one or more orientation features include a protrusion from the top surface of the cover. In various embodiments the one or more orientation features include a recess formed in the top surface of the cover.

In some embodiments the one or more orientation features include a plurality of protrusions from the top surface of the cover and are arranged in a braille format. In various embodiments the cover includes a retention aperture positioned to receive a portion of the AC plug. In some embodiments the orientation features are positioned on the cover such that a user makes contact with them during insertion of the AC plug into a corresponding receptacle connector.

In some embodiments a cover for an AC plug comprises a top wall including one or more orientation features that protrude from a top surface of the top wall. First and second sidewalls extend from the top wall in a substantially perpendicular orientation relative to the top wall. First and second retainer walls extend from the first and second sidewalls, respectively, in a substantially perpendicular orientation relative to the first and second sidewalls.

In some embodiments the first and second retainer walls define a channel. In various embodiments the top wall, the first and second sidewalls and the first and second retainer walls are arranged such that the cover has a substantially "C" shaped profile.

In some embodiments an AC plug assembly comprises an AC plug including a body defining a recess and at least two electrical prongs extending from the body and configured to be received by a receptacle connector. An orientation insert is received within the cavity and includes one or more orientation features positioned on a top surface of the orientation insert. A lighted region is configured to emit light when the top surface of the orientation insert is depressed. In various embodiments the AC plug assembly further comprises an energy storage device that receives electrical energy from the AC plug when the AC plug is mated with a corresponding receptacle connector.

In some embodiments the energy storage device provides energy to the lighted region when the AC plug is not mated with the corresponding receptacle connector and when the top surface of the orientation insert is depressed. In various embodiments the one or more orientation features include a protrusion from the top surface of the insert. In some embodiments the one or more orientation features include a recess formed in the top surface of the insert. In various embodiments the one or more orientation features include a plurality of protrusions from the top surface of the insert and are arranged in a braille format. In some embodiments the orientation features are positioned on the insert such that a user makes contact with them during insertion of the AC plug assembly into the corresponding receptacle connector.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Techniques disclosed herein relate generally to electronic plug connectors. More specifically, techniques disclosed herein relate to orientation features that are used to properly orient alternating current (AC) plug connectors before mating them with a corresponding receptacle connector that couples the plug to the AC grid. Various inventive embodiments are described herein, including methods, processes, systems, devices, and the like.

Figure 1:
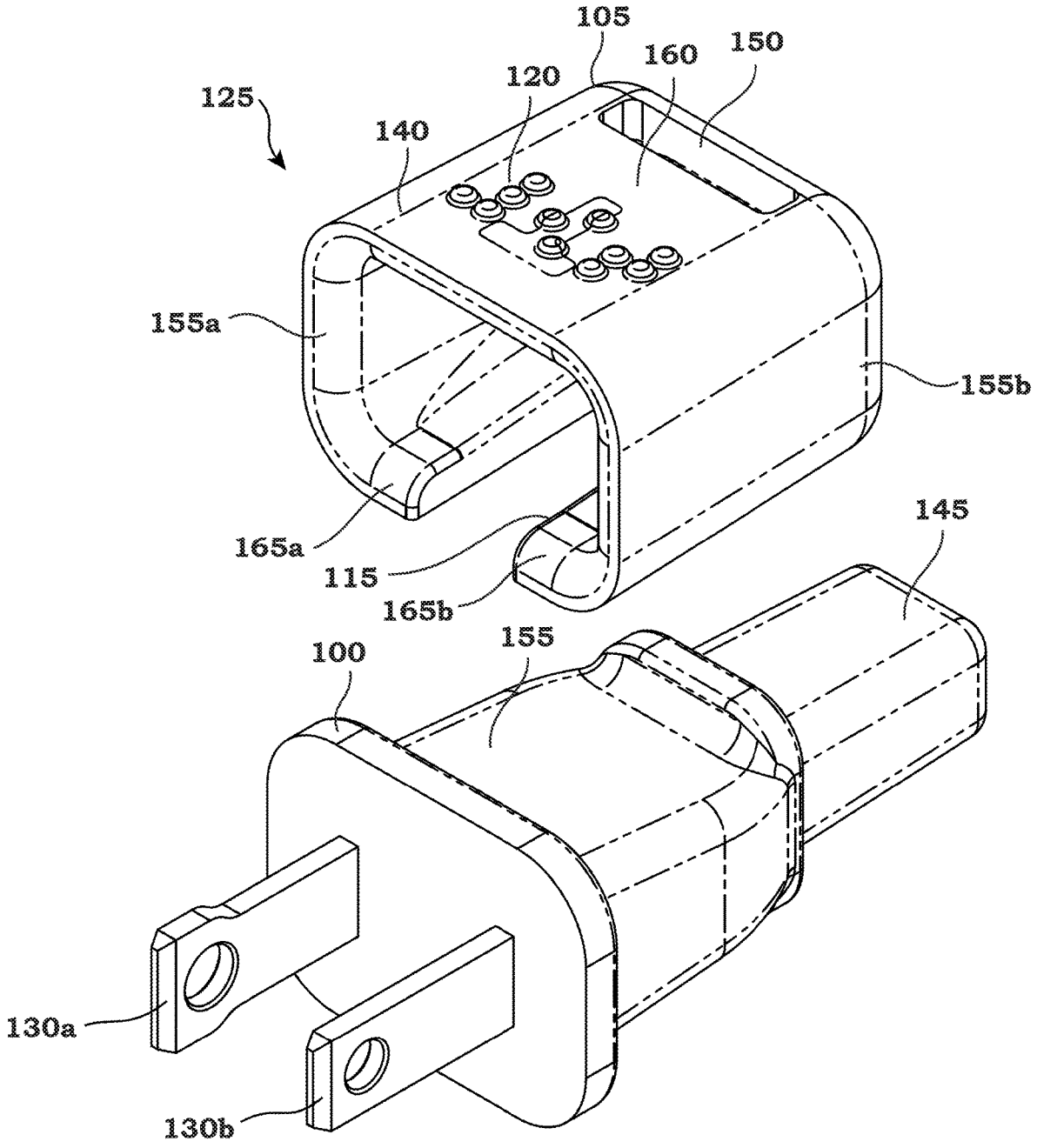
FIG. 1 is an exploded front perspective view of an AC plug and cover having an orientation device according to an embodiment of the disclosure.

FIG. 1 illustrates a simplified isometric view of a polarized AC plug 100 and an associated cover 110 that is configured to be secured to the AC plug. As shown in FIG. 1, in this embodiment cover 110 is configured to be snapped on to plug 100 via channel 115. Cover 105 includes one or more orientation features 120 such that when a user grasps plug assembly 125 that includes plug 100 and cover 105, the orientation features enable the user to determine a proper orientation of polarized AC plug prongs 130*a*, 130*b* and insert the plug with the correct orientation into an AC receptacle connector.

Figure 2:
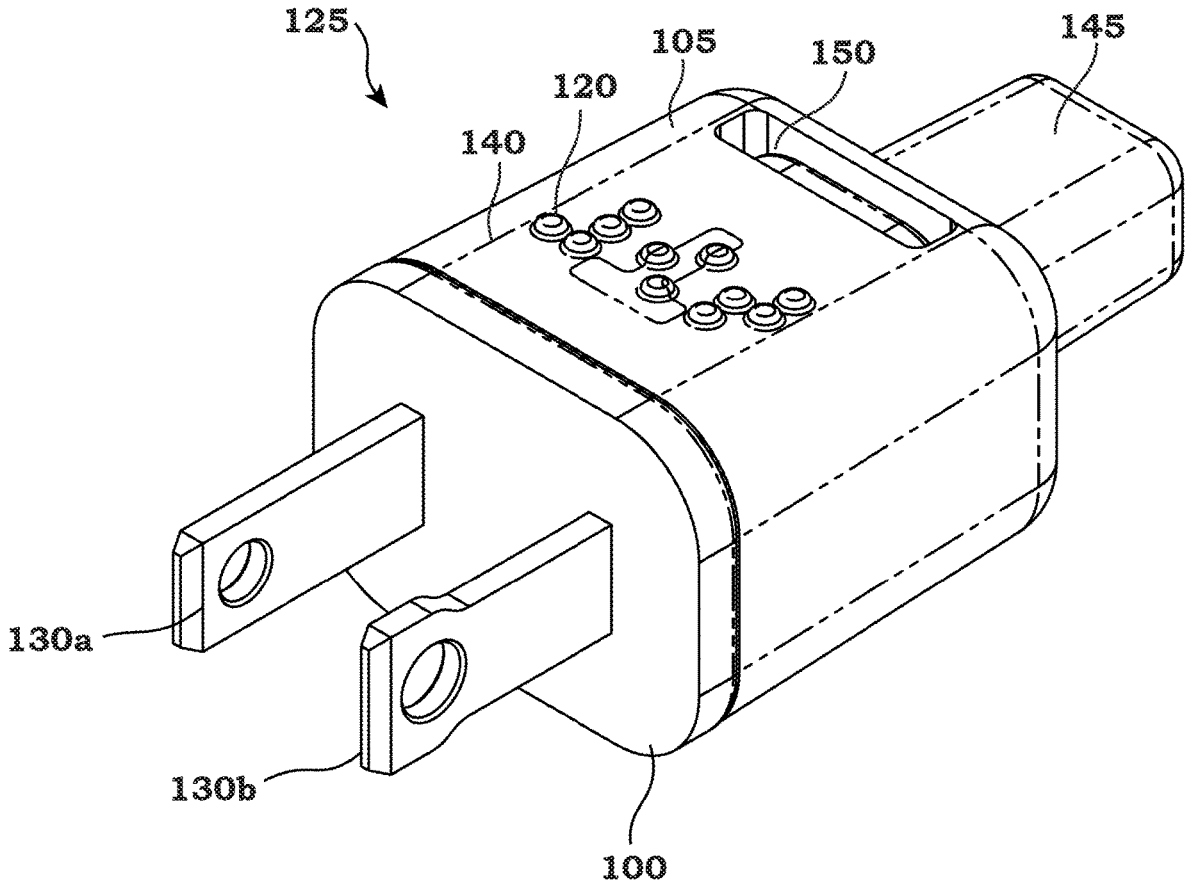
FIG. 2 is an assembled isometric view of the plug and cover shown in FIG. 1.

FIG. 2 illustrates a simplified isometric view of plug assembly 125 illustrated in FIG. 1 with cover 105 secured to plug 100. As shown in FIG. 2, cover 105 fits on AC plug 100 such that orientation features 120 are in an upward orientation when prongs 130*a*, 130*b* are in a proper orientation (e.g., polarization) to be received by a receptacle connector. In this particular embodiment, orientation features 120 include a plurality of raised features however in other embodiments different orientation features can be employed. For example in one embodiment only a single orientation feature can be used on a top surface 140 of cover 105 (e.g., a single bump or depression), however in another embodiment a plurality of braille-based bumps can be used to inform a vision impaired person that the plug is oriented properly. In another embodiment the use of raised alphabetic letters or words can be used to indicate orientation such as, but not limited to "UP" or "TOP". A logo, arrow or other symbol can be used and may be raised or may be a depression. In other embodiments any feature that can be felt, or seen by a user can be used to identify the top of plug assembly 125 so plug 100 can be oriented properly during insertion into an AC receptacle. One of ordinary skill, with the benefit of this disclosure, would recognize many variations, modifications, and alternatives.

As further shown in FIG. 1, channel 115 can enable cover 105 to be fit over cord portion 145 of plug 100 and can also enable flexure of the cover such that it can be fit around the plug and be secured in place. In some embodiments cover 105 includes a top wall 160 including one or more orientation features 120 that protrude from top surface 140 of the top wall. First and second sidewalls 155*a*, 155*b*, respectively, extend from top wall 160 in a substantially perpendicular orientation relative to the top wall. First and second retainer walls 165*a*, 165*b*, respectively, extend from the first and second sidewalls 155*a*, 155*b*, respectively, in a substantially perpendicular orientation relative to the first and second sidewalls such that the cover has a substantially "C" shaped cross-section or profile.

In some embodiments cover 105 can be designed for a particular "standardized" plug 100 design, while in other embodiments it may be universal to work with numerous different plug configurations. In yet further embodiments cover 105 may be secured to plug 105 using an adhesive, a fastener or any other suitable means to secure the cover to the plug. In some embodiments a retention aperture 150 can be used to allow a portion of plug connector 100 to fit within the aperture and secure cover 105 to the plug connector. One of ordinary skill, with the benefit of this disclosure, would recognize many variations, modifications, and alternatives. In one embodiment plug 100 meets the specification of the National Electrical Manufacturers Association (NEMA) 1-15 having a defined polarization, however any plug can be used including, but not limited to the "europlug" CEE 7/4 (Germany), CEE7/5 (French), NEMA (US), AS/NZS3112 (Australian/new Zealand), NBR 14136 (Brazilian), BS546 (British), BS1363 (British) or GB2099.1-2008 and GB 1002-2008 (China). In other embodiments cover 105 can be configured to fit other types of electrical connectors, such as, but not limited to a universal serial bus (USB) connector.

In some embodiments instead of orientation feature 120 being secured to plug 100 using cover 105, the orientation features can be formed directly into a body 155 of the plug 100. More specifically, in some embodiments plug body 155 can include orientation features 120 formed from a portion of the plug body.

In some embodiments cover 115 can be formed from various different colors and designs that can be used to identify a particular plug that may correspond to a particular electronic device. For example in situations with many plug connectors, cover 105 can be formed using different colors such that only cords with, for example, red covers are associated with lighting devices and only cords with, for example yellow covers are associated with acoustic devices. In this way, not only does cover 105 provide proper orientation for plug 100, but the cover associates a particular plug with a particular electronic device. In yet further embodiments, cover 105 can have different orientation features that can be associated with a particular device. In one example a braille-type orientation feature 120 can indicate to a user that the plug is for a television, and a different cover with a different braille-type orientation feature can indicate to a user that the plug is for a stereo. One of ordinary skill, with the benefit of this disclosure, would recognize many variations, modifications, and alternatives.

In some embodiments cover 105 can be made from a flexible plastic material, however in other embodiments it can be made from any organic or metallic material.

Figure 3:
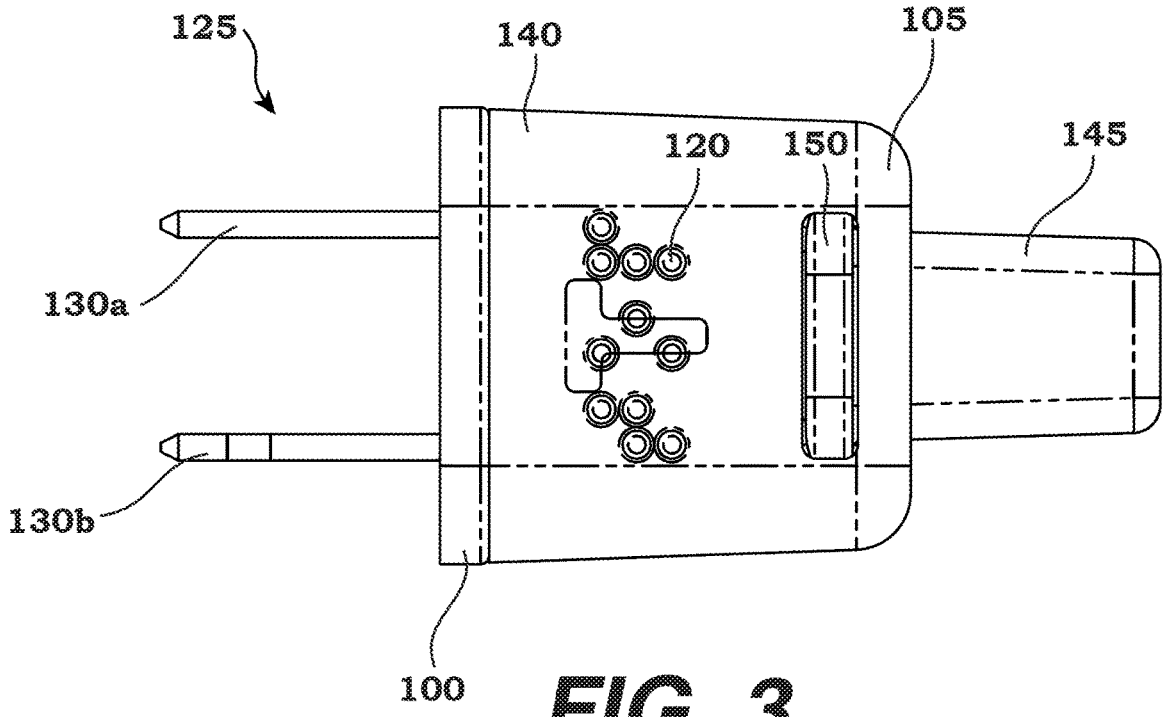
FIG. 3 is an assembled plan view of the plug and cover shown in FIG. 1.

FIG. 3 illustrates a top view of cover 105 installed on plug 100. As shown in FIG. 3, orientation features 120 can be positioned on a top surface 140 of cover 105.

Figure 4:
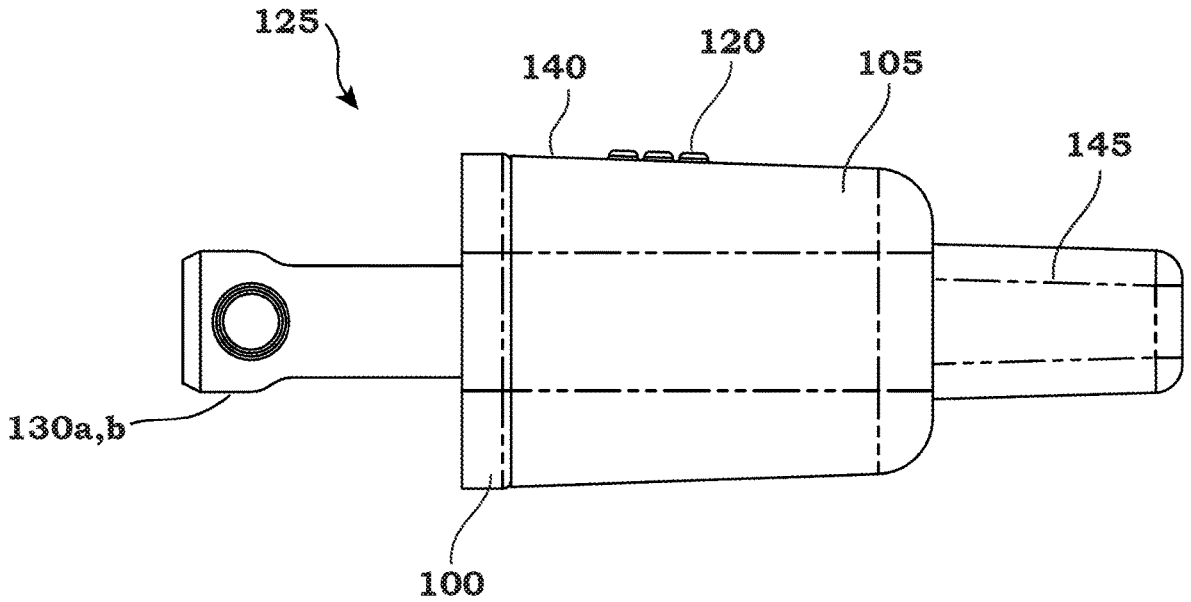
FIG. 4 is an assembled side view of the plug and cover shown in FIG. 1.

FIG. 4 illustrates a side view of cover 105 installed on plug 100. As shown in FIG. 4, orientation features 120 can be positioned on top surface 140 of cover 105 and can protrude above the top surface so they can be felt by a user.

Figure 5:
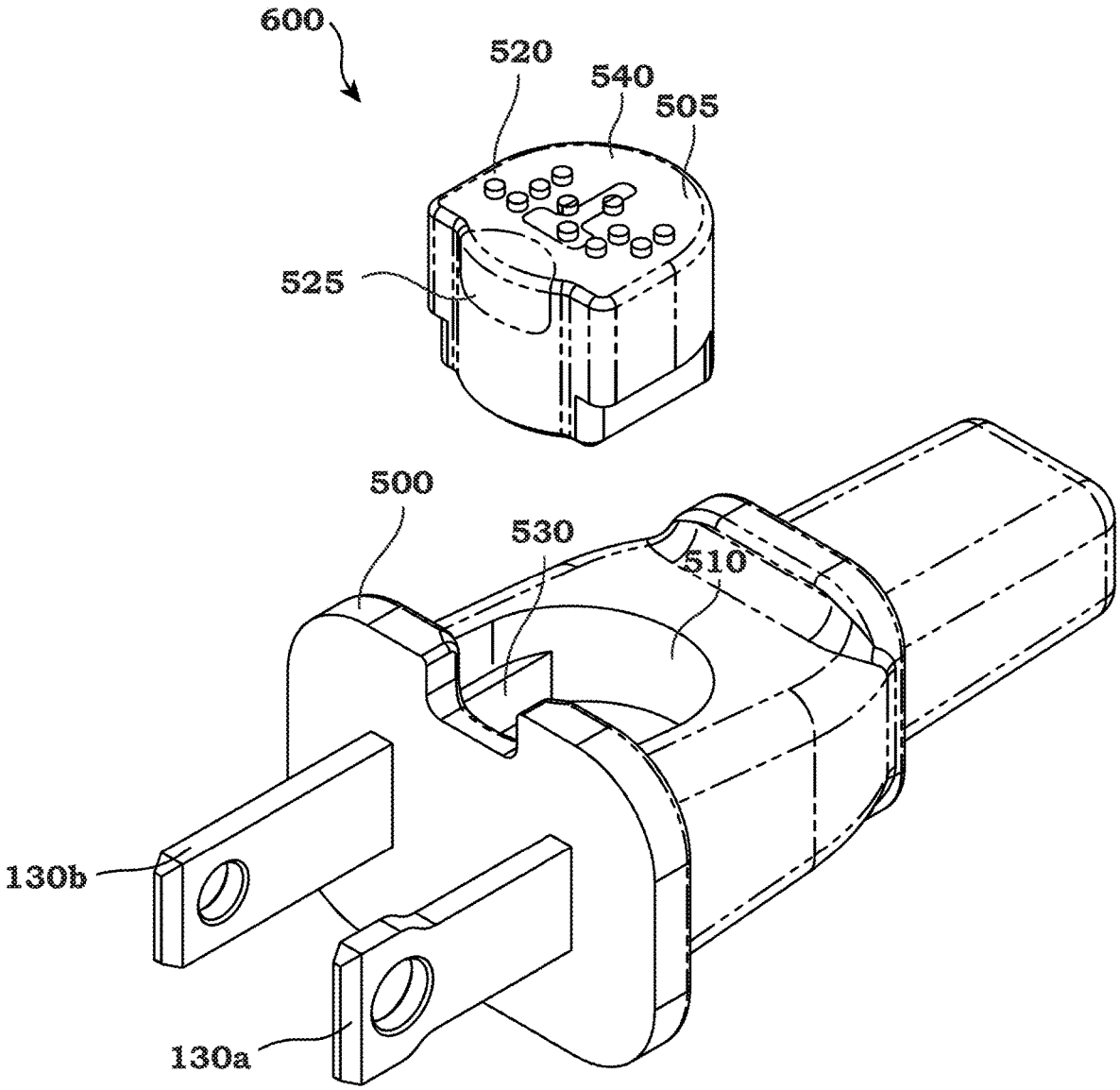
FIG. 5 is an exploded front perspective view of an AC plug and orientation insert according to an embodiment of the disclosure.
Figure 6:
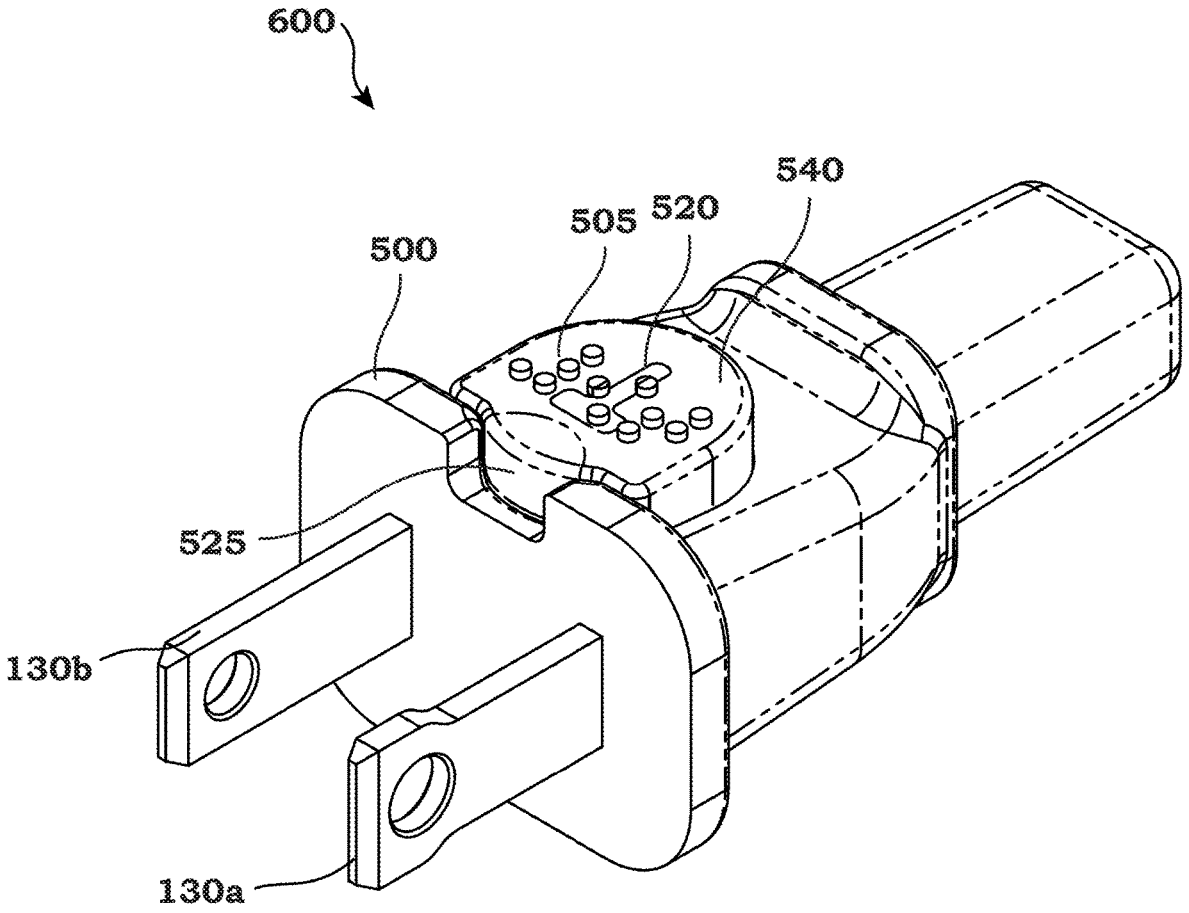
FIG. 6 is an assembled isometric view of the plug and orientation insert shown in FIG. 5.

FIG. 5 illustrates a simplified isometric view of a plug connector 500 with an orientation insert 505, according to embodiments of the disclosure. As shown in FIG. 5, plug 500 includes a cavity 510 that is configured to receive insert 505. FIG. 6 illustrates a simplified isometric view of plug assembly 600 that includes plug 500 with insert 505 received within cavity 510. In some embodiments insert 505 can include one or more orientation features 520 so that by touch a user can determine an orientation of the polarized AC plug 500 and insert it with the correct orientation into an AC receptacle connector.

In addition, orientation insert 505 can include circuitry, an energy storage device, a light and/or a switch (not shown in FIG. 5 or 6) so that a person can activate the switch and illuminate a region in front of plug 500 so they can see the receptacle connector when it is in a dark location. More specifically, orientation insert 505 can be equipped with a lighted region 525 that is directed towards prongs 130*a*, 130*b* such that light emitted from the lighted region will illuminate an designated receptacle connector. In some embodiments the switch that controls lighted region 525 can be a pressure sensitive switch disposed under orientation feature 520. In further embodiments the energy storage device can be electrically coupled to AC plug 500 such that when the AC plug is receiving power from a receptacle connector the energy storage device is charged. In another embodiment wireless charging can be used to charge the energy storage device. When AC plug assembly 600 is unplugged from the receptacle connector the light can use energy from the energy storage device. In one embodiment the light is an LED while in another embodiment it is a glow-discharge device and in another embodiment is an incandescent light. In one embodiment the energy storage device is a rechargeable battery an in another embodiment it is a capacitor or other type of energy storage device.

Orientation insert 505 can be secured within recess using one or more snap features or any type of adhesive or fastener. Orientation insert 505 can be equipped with one or more electrical couplers (not shown) that couple to prongs 130*a*, 130*b* and/or electrical conductors 530 within plug 500 to provide electrical power to the circuitry within the orientation insert. In some embodiments, orientation insert 505 can be made from different materials with a relatively soft plastic forming the top portion that deflects under pressure to operate the switch and the remaining portion made out of a relatively harder plastic to be secured to AC plug 500.

Although a United States standard AC plug 500 is illustrated, one of skill in the art can appreciate that other types of electrical plugs can benefit from similar orientation inserts, some of which are described herein with regard to FIGS. 1-4. In further embodiments orientation insert 505 may not be an insert and may be integrally formed with plug 500 body.

Figure 7:
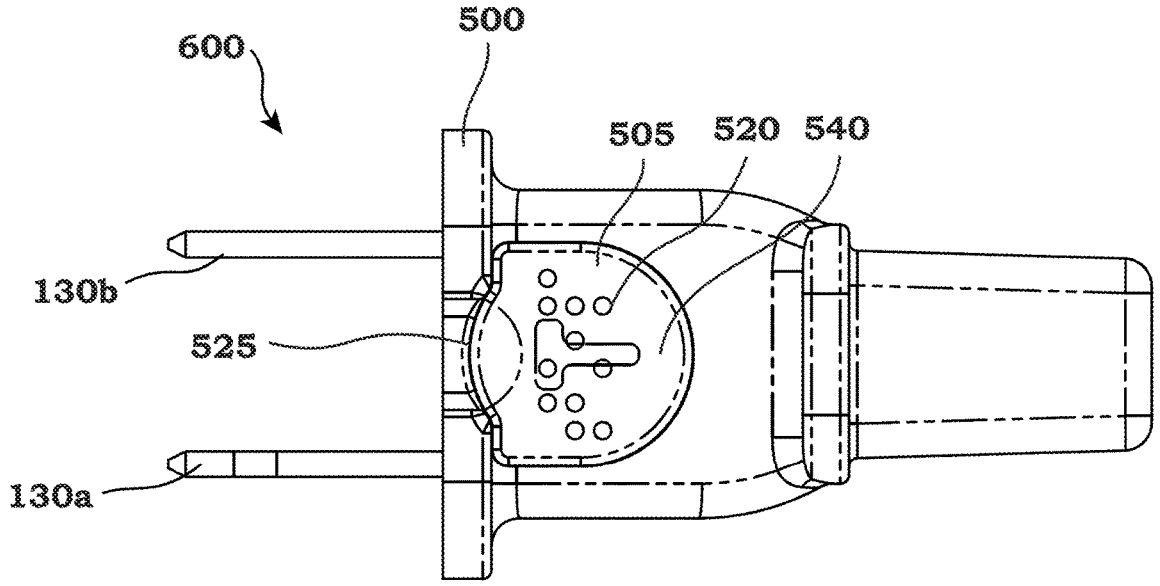
FIG. 7 is an assembled plan view of the plug and orientation insert shown in FIG. 5.

FIG. 7 illustrates a top view of orientation insert 505 installed in plug 500. As shown in FIG. 7 orientation features 520 can be positioned on a top surface 540 of cover.

Figure 8:
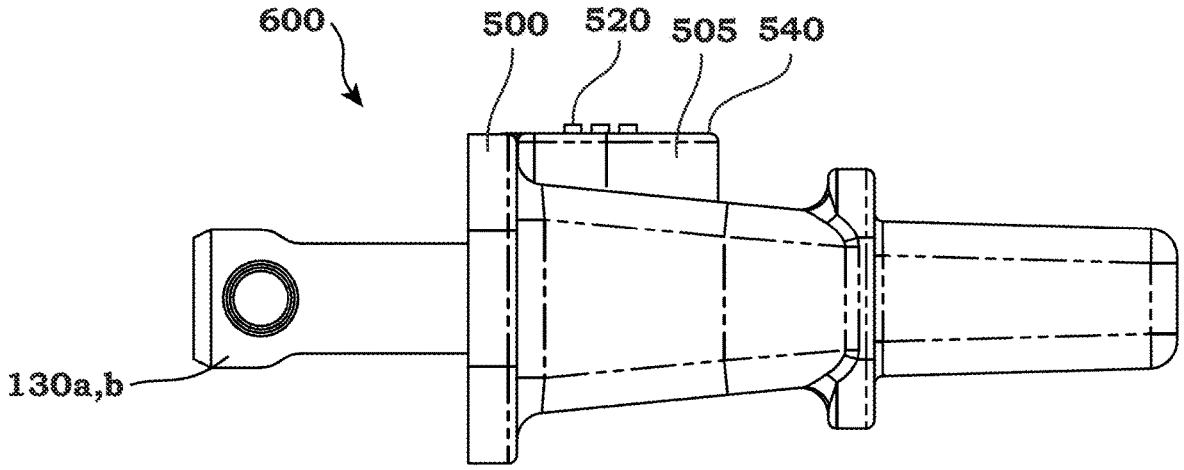
FIG. 8 is an assembled side view of the plug and orientation insert shown in FIG. 5.

FIG. 8 illustrates a side view of orientation insert 505 installed in plug 500. As shown in FIG. 8 orientation features 520 can be positioned on a top surface 540 of orientation insert 505 and can protrude above the top surface so they can be felt by a user.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

What is claimed is:

1. An orientation device for an AC plug, the orientation device comprising:

a cover including a wall formed in a shape of a clip configured to be attached to the AC plug, the cover including a top portion defining a top surface having one or more orientation features, the cover further including a pair of sidewalls extending from the top portion, wherein the top portion defines a retention hole arranged to receive a portion of the AC plug, the retention hole extending from an interior surface of the wall to the top surface and having a closed perimeter;

wherein the one or more orientation features are disposed between the pair of sidewalls and adjacent the retention hole.

2. The orientation device of claim 1 wherein the cover is formed in a shape of a clip defining a channel.

3. The orientation device of claim 1 wherein the cover has a substantially "C" shaped cross-section including the top surface having a pair of arcuate sidewalls extending therefrom.

4. The orientation device of claim 1 wherein the one or more orientation features include a protrusion from the top surface of the cover.

5. The orientation device of claim 1 wherein the one or more orientation features include a recess formed in the top surface of the cover.

6. The orientation device of claim 1 wherein the one or more orientation features include a plurality of protrusions from the top surface of the cover and are arranged in a braille format.

7. The orientation device of claim 1 wherein the orientation features are positioned on the cover such that a user makes contact with them during insertion of the AC plug into a corresponding receptacle connector.

8. An AC plug assembly comprising:

an AC plug including a body defining a recess extending from a receiving opening to a bottom wall;

at least two electrical conductors positioned within the recess proximate the bottom wall;

at least two electrical prongs extending from the body and configured to be received by a receptacle connector; and an orientation insert at least partially received within the cavity such that a portion of the orientation insert protrudes out of the body, the orientation insert including:

one or more orientation features positioned at a top surface of the orientation insert, wherein the top surface is proximate an outer surface of the body;

one or more electrical couplers in direct contact with the at least two electrical conductors and configured to receive electrical power from the at least two electrical conductors; and a lighted region configured to emit light when the top surface of the orientation insert is depressed.

9. The AC plug assembly of claim 8 further comprising an energy storage device that receives electrical energy from the one or more electrical couplers when the AC plug is mated with a corresponding receptacle connector.

10. The AC plug assembly of claim 9 wherein the energy storage device provides energy to the lighted region when the AC plug is not mated with the corresponding receptacle connector and when the top surface of the orientation insert is depressed.

11. The AC plug assembly of claim 8 wherein the one or more orientation features include a protrusion from the top surface of the insert.

12. The AC plug assembly of claim 8 wherein the one or more orientation features include a recess formed in the top surface of the insert.

13. The AC plug assembly of claim 8 wherein the one or more orientation features include a plurality of protrusions from the top surface of the insert and are arranged in a braille format.

14. The AC plug assembly of claim 8 wherein the orientation features are positioned on the insert such that a user makes contact with them during insertion of the AC plug assembly into the corresponding receptacle connector.

* * * * *